US006126809A

United States Patent [19]

Larsen

[11] Patent Number: 6,126,809

[45] Date of Patent: Oct. 3, 2000

[54] METHOD FOR CONTROLLING THE FEED OF ALUMINA TO ELECTROLYSIS CELLS FOR PRODUCTION OF ALUMINUM

[75] Inventor: Asbjørn Sigurd Larsen, Haugesund, Norway

[73] Assignee: Norsk Hydro ASA, Olso, Norway

[21] Appl. No.: 09/274,908

[22] Filed: Mar. 23, 1999

[30] Foreign Application Priority Data

Mar. 23, 1998 [NO] Norway ..... 981303

[51] Int. Cl.[7] ..... C25C 3/20

[52] U.S. Cl. ..... 205/336

[58] Field of Search ..... 205/336

[56] References Cited

U.S. PATENT DOCUMENTS

| | | | |
|---|---|---|---|
| 3,622,475 | 11/1971 | Shiver et al. | 205/336 |
| 3,660,256 | 5/1972 | Lippitt et al. | 205/336 |
| 3,712,857 | 1/1973 | Piller | 205/336 |
| 4,035,251 | 7/1977 | Shiver et al. | 205/336 |
| 4,425,201 | 1/1984 | Wilson et al. | 205/336 |
| 4,431,491 | 2/1984 | Bonny et al. | 205/336 |
| 4,654,129 | 3/1987 | Leroy | 205/336 |
| 4,654,130 | 3/1987 | Tabereaux | 205/336 |
| 4,675,081 | 6/1987 | Girard | 205/336 |
| 5,089,093 | 2/1992 | Blatch et al. | 205/336 |

FOREIGN PATENT DOCUMENTS

| | | |
|---|---|---|
| 9858463 | 3/1998 | Australia . |
| 44 43 225 | 6/1996 | Germany . |
| 55-145188 | 11/1980 | Japan . |
| 157906 | 2/1982 | Norway . |
| 166821 | 9/1986 | Norway . |
| 172192 | 12/1986 | Norway . |
| 972723 | 6/1997 | Norway . |
| 1548270 | 3/1990 | Russian Federation . |
| 2106435 | 11/1996 | Russian Federation . |

*Primary Examiner*—Bruce F. Bell
*Attorney, Agent, or Firm*—Wenderoth, Lind & Ponack, L.L.P.

[57] ABSTRACT

A method is described for controlling the supply of aluminium oxide to electrolysis cells for the production of aluminium in which the control is based on measurement of the electrical resistance between the electrodes of the electrolytic furnace and in which the value of this resistance is registered at fixed intervals of time. On the basis of the resistance values registered, at a given time an angle can be calculated between two lines, where one line is formed on the basis of values registered after said time and the other line is formed on the basis of values registered before said time. A curve can be generated on the basis of the angle. By comparison with periods of underfeeding and overfeeding, it is possible to obtain information on the oxide concentration in the electrolysis bath of the cell.

7 Claims, 5 Drawing Sheets

| | |
|---|---|
| R | Cell resistance |
| C | Oxide concentration in bath |
| t | Time |
| U | Underfeeding of oxide |
| H | Overfeeding of oxide |

+ disturbances from other variables can produce:

+ disturbances from other variables can produce:

+ disturbances from other variables can produce:

| | |
|---|---|
| β | Angle |
| C | Oxide concentration in bath |
| t | Time |
| H | Overfeeding |
| U | Underfeeding |

METHOD FOR CONTROLLING THE FEED OF ALUMINA TO ELECTROLYSIS CELLS FOR PRODUCTION OF ALUMINUM

The present invention concerns a method for controlling the supply of aluminium oxide to electrolysis cells for the production of aluminium in which the control is based on measurement of the electrical resistance between the electrodes of the electrolytic furnace and in which the value of the resistance is registered at fixed intervals of time.

BACKGROUND OF THE INVENTION

Known control strategies for point feeding are based in principle on an ideal correlation between the cell resistance and the oxide concentration which is represented by a U-shaped curve in which the concentration is given along the x axis and the cell resistance along the y axis. See FIG. 1, top curve. The base of the curve will usually lie at 4% oxide concentration. Such a control strategy involves controlling the cell by keeping the concentration low, below 4%. In this area, the cell resistance will increase as the concentration decreases while it will decrease as the concentration increases. In practice, this can done in such a way that, if the cell resistance is measured, for example, at a value corresponding to an oxide concentration of 2%, the cell can be overfed with oxide so that the oxide concentration in the bath increases. After a period of time, typically 30–60 minutes, the oxide concentration will typically be approximately 3% and the cell resistance will have decreased. The cell will subsequently be underfed with oxide so that the concentration falls again. When the oxide concentration is 2% again, a new overfeeding period can be started. Using this control strategy, the cell is excited in respect of the oxide in order to obtain a signal in the cell resistance which is used to control the cell's oxide concentration in the bath at a relatively low level. The term "R signal" will be used in the following as a designation of the cell resistance in the periods surrounding a change in feed rate. In the following, the term "rapid feeding" represents a fixed overfeed rate.

| Definitions: | |
|---|---|
| U | Period of time with underfeeding |
| R | Period of time with rapid feeding |
| UH period | Period of time with U + H |
| H on | Start time for rapid feeding |
| U on | Start time for underfeeding |

A so-called anode effect occurs if the oxide concentration in the bath becomes low enough (approximately 1.8%). In connection with the anode effect, it is normal for the voltage immediately to rise to approximately 50 volts. The effect normally lasts approximately 5 minutes. Special measures are usually necessary to remove the anode effect. Anode effects may be desired or undesired. One advantage of the point feeding technology is that the frequency of anode effects can be reduced radically.

The energy supply to an electrolysis cell can be controlled by adjusting the anode up and down in the periods without an anode effect. Automatic adjustment is based on measurement of the cell's ohmic resistance. If the measurement is outside a deadband around a resistance reference, the anode is adjusted. An upper and a lower deadband are used. The two deadbands and the reference can vary automatically depending on the state of the cell.

In order to optimise the operating conditions and to maximise the financial return, it is desirable to keep a low concentration of oxide in the bath. In order to determine the point which corresponds to an oxide concentration of approximately 2%, i.e. a concentration which is normally slightly higher than that which may produce an anode effect in the cell, the level change in the resistance is used, for example, in a period before the point is reached, or the angle coefficient of the resistance near to this point. The angle coefficient of the resistance can be determined on the basis of an equation for a straight line in an x-y co-ordinate system, i.e. $y=ax+b$, where a is the angle coefficient. A control strategy may be based on a combination of both level change in the resistance and the angle coefficient of the resistance. The decision that the point has been reached is called prediction (i.e. anode effect prediction).

The problem with known prediction methods is that the ideal correlation between the resistance and the concentration on which the methods are based can be seriously disturbed by other conditions in the cell, conditions which affect the development of the resistance over time. Such disturbances are particularly large in Søderberg cells and lead to many false predictions. False predictions are predictions which occur at relatively high oxide concentrations in the bath. True predictions are predictions which occur at sufficiently low oxide concentrations in the bath.

Change in resistance on account of the absorption of oxide sludge from the base and side coating is an example of a disturbance. The absorption of sludge causes the metal level to fall with an increase in resistance as a result. The change in resistance per time unit depends on many factors such as the supply of energy to decompose the oxide, the quantity of sludge in the cell, the chemical and mechanical availability of the sludge, the geometry of the side coating, the bath quantity, etc. Mechanical availability in this connection includes the liquid flows in the bath and metal, among other things. The flow paths and physical flow rates are significant.

In all aluminium electrolysis cells, the oxide concentration in the bath will always depend on two oxide sources: oxide supplied to the bath from the outside and oxide supplied to the bath from the inside. Oxide from the inside comes from base sludge and the side coating. In connection with the supply of oxide to the cell through the bath cake at a point feeding point, some oxide may pass through the bath phase without being decomposed. This oxide becomes sludge. The quantity which becomes sludge depends, among other things, on the oxide concentration in the bath and the local supply of energy to the oxide dose. A high concentration and low "overtemperature" favour the formation of sludge. Overtemperature means the difference between the temperature in the bath and the bath's melting point (liquidus temperature). The above two oxide flows can vary greatly in a point-fed Søderberg cell. In a point-fed prebake cell, the oxide flow from the feed points normally dominates.

If a cell has a lot of easily available sludge, a high concentration of oxide in the bath can be maintained for a long period through sludge absorption. The sludge which disappears will often lead to an increase in resistance. This increase in resistance often leads to false predictions. The prediction produces a relatively high feed rate of oxide through the feeders for a certain period of time (overfeeding). In this way, oxide is supplied which gradually becomes new sludge. The high concentration of oxide in the bath can last for a long time. Periods of high concentration reduce the financial return.

Other variables in a cell can also lead to false predictions, for example temperature change, change in bath chemistry and change in the shape of the side coating.

Other examples of states in which a known control does not always work expediently are the period after an anode effect, the period after tapping, the period after side or end precipitation, other periods with a high oxide concentration in the bath, periods with an extremely low oxide concentration in the bath, periods with high noise in the cell's resistance, periods with high sludge absorption and periods with a high temperature in the bath.

With reference to the above, known control strategies will be characterized to a greater or lesser degree by false predictions and high oxide concentration because a good enough overview of the oxide concentration is not available at any point in time. Søderberg cells are normally more subject to false predictions than prebake cells.

There is, therefore, a great need for a control strategy which can contribute to achieving good control over the oxide concentration so that the predictions made are true.

SUMMARY OF THE INVENTION

With the present invention, the point feeders are controlled so that operation is optimised with regard to oxide concentration, sludge formation and the quantity of sludge in the cells. The method has a robust resistance to disturbances in the R signal.

The present invention differs from the state of the art shown in, for example, Norwegian patent no. 166.821(ĂSV) or Norwegian patent no. 172.192 and EPO 044 794 (Aluminium Pechiney), among other things through the following:

In accordance with the present patent application, the cell's resistance and events in the process are monitored on a continuous basis. This monitoring is combined with the techniques described to avoid incorrect interpretation of the measurements. In periods in which a known control would lead to an unfavourable development on account of incorrect interpretation, the oxide supply to the cell is controlled using fixed feed strategies for oxide regardless of the resistance of the cell. At the same time, fixed strategies for the supply of energy are followed. These strategies are designed so that the cell reaches a state at which a known control can be introduced again as soon as possible. The strategies are also designed so that, in the long term, they systematically counter sludge formation and lead to the collection of sludge.

The form of the R signal can, for example, be detected using the following technique (see FIG. 2): β is the angle between two straight lines where one line, E, the oldest line, is drawn through 10 points on the resistance curve, which here corresponds to a period of 20 minutes. The other line, Y, the youngest line, is drawn through the next 10 points. A curve β is produced by the lines being moved one measurement forwards at a time, i.e. 2 minutes. The terms β curve and angle curve are used in the following about the curve β. β and the angle coefficients for E and Y are examples of so-called UH parameters. See the definition later.

BRIEF DESCRIPTION OF THE INVENTION

The method will be described in the following in further detail using the following examples and figures where:

FIG. 1 is a curve which shows the correlations between the cell resistance R and the oxide concentration in the bath, FIG. 2 shows the course of a typical cell resistance R, the associated β curve and the feed rates for a cell in the same diagram. The curve for R coordinate-transformed so that it can be produced in the same diagram as β, FIG. 3 shows the fundamental correlations which are found between the β curve, the oxide concentration in the bath and the feed rates, FIG. 4 shows a typical β curve before and after an anode effect, FIG. 5 shows registration of the hysteresis effect.

DETAILED DESCRIPTION OF THE INVENTION

Figure 1:
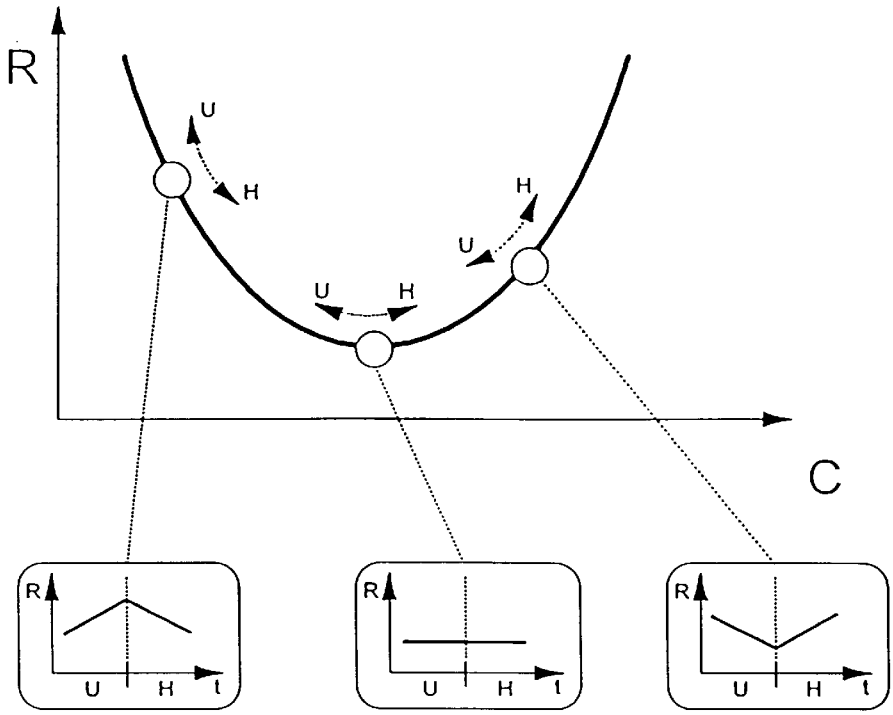
Figure 1:
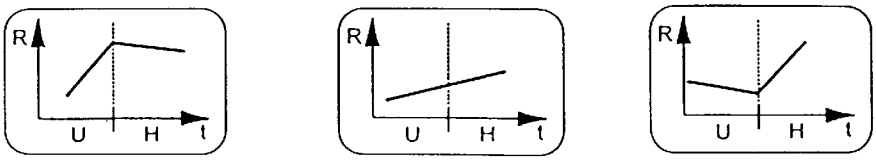

The method utilises the historical knowledge about the shape of a resistance curve over a period of time which includes an underfeeding period and the subsequent overfeeding period. This period will subsequently be called the "R signal period". At low oxide concentrations in the bath, under ideal conditions there will be a downward deflection in the resistance curve at the transition between underfeeding and overfeeding. At concentrations of approximately 5% and over, the curve will be deflected upwards. At concentrations close to approximately 4%, there will be little or no deflection. The effect of sludge absorption and other "disturbances" in the R signal will be added to the ideal curves. In Søderberg cells, a frequent observation is that such effects lead to the R signal turning anticlockwise. See FIG. 1.

At low concentrations, the R signal breaks so that the rate of increase in connection with overfeeding is lower than the rate of increase in connection with underfeeding. At higher concentrations, the break in the R signal is less sharp. The break may even be completely absent. In other words, the R signal has characteristic forms which depend on the oxide concentration in the bath.

The R signal period can be described by numerical adaptation of a suitable mathematical function, subsequently called the UH function. A UH function could, for example, be a parabola. In this method, two lines E and Y are used (see the definition of β above and FIG. 2). The mathematical function is adapted to the resistance curve for a fixed period of time of from 30 to 60 minutes. The function is clearly described by its parameters, the UH parameters. β and the angle coefficient for Y are chosen as the UH parameters. By moving the function which is adapted forwards one measurement at a time, new values are produced for the UH parameters. Every single UH parameter can be produced as a time-variable curve. The parameters vary with the oxide concentration in the bath. The UH parameters can vary from cell to cell even if the cells have the same oxide concentration in the bath. In the same cell, the parameters at a fixed oxide concentration level can also be changed with time, but this change is slow. Using an adaptive data mechanism, the expected value for a cell's UH parameters close to the anode effect concentration can be determined. The influence of any anode adjustments on the resistance curve can be eliminated with simple techniques before the UH parameters are calculated.

Figures from experience may be used for the expected value of the UH parameters. The figures from experience may be the same for several cells. The figures from experience may also be individual for each cell. Which method is best depends on the uniformity and stability in the overall set of cells involved.

The oxide concentration in the bath can be estimated at any time by comparing current UH parameters with expected parameter values. The control program keeps account of the quantity supplied through the feeders. Using this information and the course of the UH parameters, the oxide supply to the bath which is not from the feeders can be estimated. Auto-feeding from the sludge and side coating will normally dominate. "Auto-feeding" is therefore defined as oxide supply to the bath from the sludge and side coating.

It is expedient for the duration of underfeeding and overfeeding in the next UH period to be decided in the previous UH period so that the oxide concentration in the bath has an optimal course. In the UH period, the upper deadband for anode adjustment is relatively high until the end of the overfeeding period. The deadband is then reduced. In this way, the anode adjustments are matched to the UH period. Normally, only special disturbances lead to anode adjustment during the period otherwise, for example tap, end precipitation, bolt drawing, noise handling, etc. In the event of major disturbances in the R signal (noise), the estimated oxide concentration in the bath is rejected as control information for the current UH period. In the event of anode regulation, the effect of the disturbance on the resistance curve is eliminated before the variables are calculated.

In connection with estimation, the information from, for example, the last two UH periods can be used and filtered so that the last approved value counts more than the previous value, etc.

The UH periods can expediently be made as short as possible. However, they must be long enough to ensure that the information in the resistance curve (the R signal) does not deteriorate.

The optimal development of the oxide concentration in the bath is determined by the situation and is adapted to the degree of feeding from the sludge in the cell. With a low oxide concentration in the bath and little supply from the sludge, a great deal of oxide must be dosed through the point feeders to avoid the anode effect. If the point feeders produce more oxide during a period of time than the quantity consumed, the surplus oxide will normally produce relatively easily available sludge and/or an increase in the oxide concentration in the bath.

For a period of time just after an anode effect, oxide is supplied through the feeders in fixed quantities per unit of time so that the oxide concentration has an optimal course. Predictions are not used in the control during this period. From the end of this period, the above control mechanism can be used.

Tests were performed on Søderberg cells to study the correlation between resistance signals and feed rates at different oxide concentrations. During the tests, the cells had "rhythm feeding", i.e. predetermined durations for both underfeeding U and rapid feeding H in periods in which predictions may be used in the control mechanism. The supply of oxide was adjusted so that the oxide concentration in the bath was kept at approximately the same level for long periods of time. U was changed during the tests. H was set at 30 minutes.

During the tests, a "hysteresis effect" was registered at oxide concentrations in the bath below 4% in some cells. For long periods of time, the resistance signals were the opposite of what was expected. The cell resistance decreased with underfeeding and increased with rapid feeding. The reaction of the cells during the test can be explained by the fact that rapid feeding produces a growing oxide layer which floats on the metal and increases the cell resistance while the oxide layer and the resistance decrease with underfeeding. The above observation will generally be a disturbance regarding the control of the oxide feeders to the cell.

Detection of a hysteresis effect indicates too low energy supply for the oxide which is supplied to the cell. The oxide is not chemically decomposed. The combination of local bath flows and local energy conditions in the cell can cause this state. If the state is detected in connection with rhythm feeding, the oxide supply through the feeders can be reduced temporarily and the resistance reference increased temporarily in the cell. These measures are started automatically when the other conditions are present. The extent and duration of the measures can be controlled by parameters which are set manually or automatically.

However, it has been found that the oxide concentration can be monitored using "angle detection", which will be described in the following. When the angle detection shows a high concentration, rhythm feeding can be used until the angle detection shows that the concentration is low. At a low concentration, known prediction mechanisms can be used to control the feeding. At an extremely low concentration (close to the anode effect state), energy pulses and a high feed rate can be used to avoid the anode effect. The resistance curve is monitored continuously and in parallel using angle detection.

Figure 3:
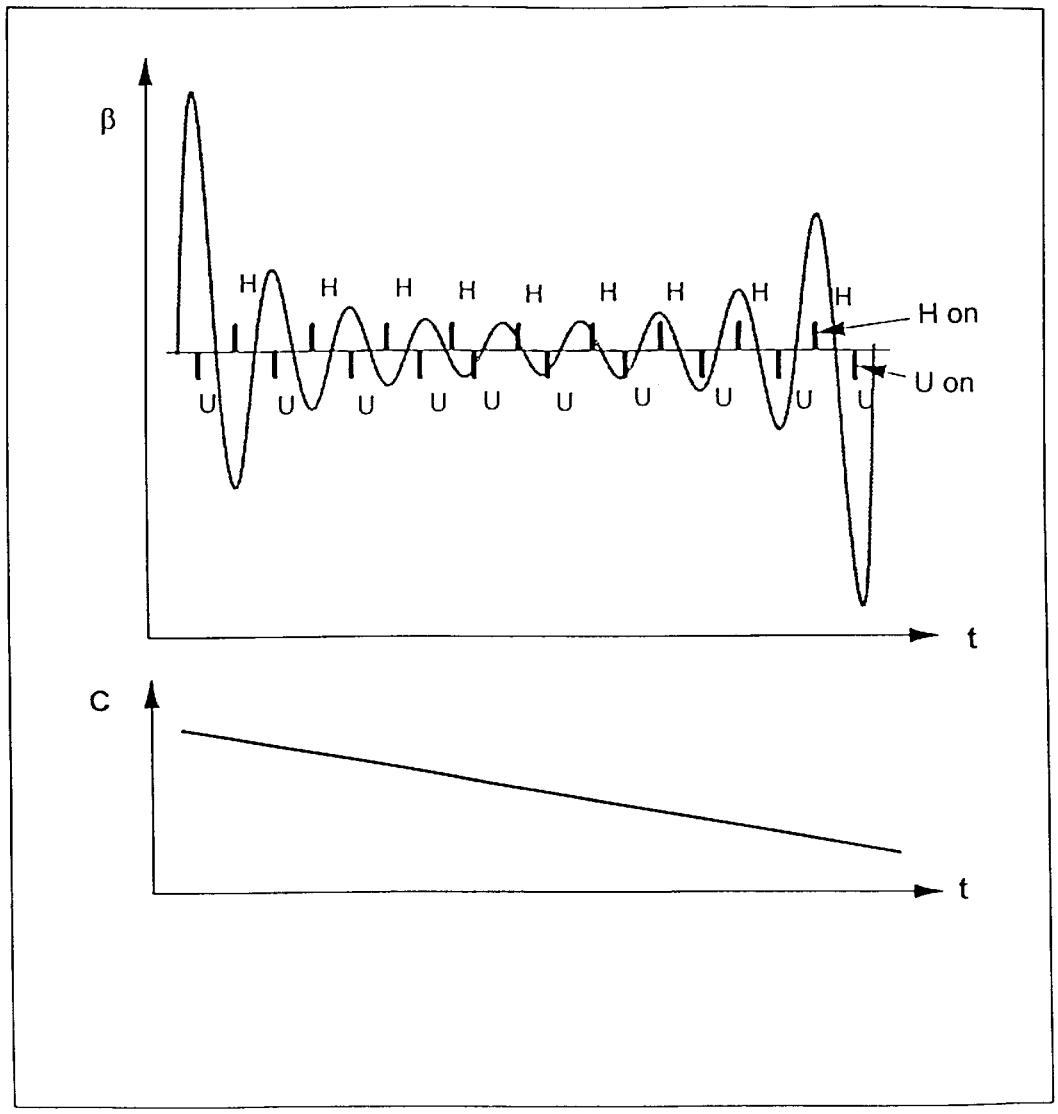

FIG. 3 shows the fundamental correlation which has been found between the feed rate, the angle curve and the oxide concentration. The correlation is based on results from tests and the upper part of the figure shows bars for "U on" and "H on" and "β angle" as a function of time. The lower part of the figure shows the corresponding oxide concentration as a function of time. The last R signals are ideal in relation to conventional control strategy in the time before the anode effect. The bars for "H on" and "U on" are as they should be in relation to the β curve. The figure shows that the last 6 bars are "inside" the curve. This means that the resistance increases with underfeeding and decreases with rapid feeding. The time difference here is small between the bar and the corresponding maximum or minimum on the curve. When the bars are inside the β curve and the deflections are relatively large, it was registered that the oxide concentration is low. When calculating β in FIG. 3, the influence of the anode adjustments on the cell resistance R was not eliminated.

The first bars are, however, "outside" the curve. These measurements were taken at a higher oxide concentration and with such a state it was registered that the bars are outside the curve and the curve has large deflections. These measurements indicate that the resistance increases with rapid feeding and decreases with underfeeding, which indicates a state in which oxide is not decomposed to the desired extent.

At a medium oxide concentration, the deflections of the angle curve are relatively small. The bars can be inside or outside the β curve. The time difference here is relatively large between the bar and the nearest maximum or minimum on the curve.

Figure 2:
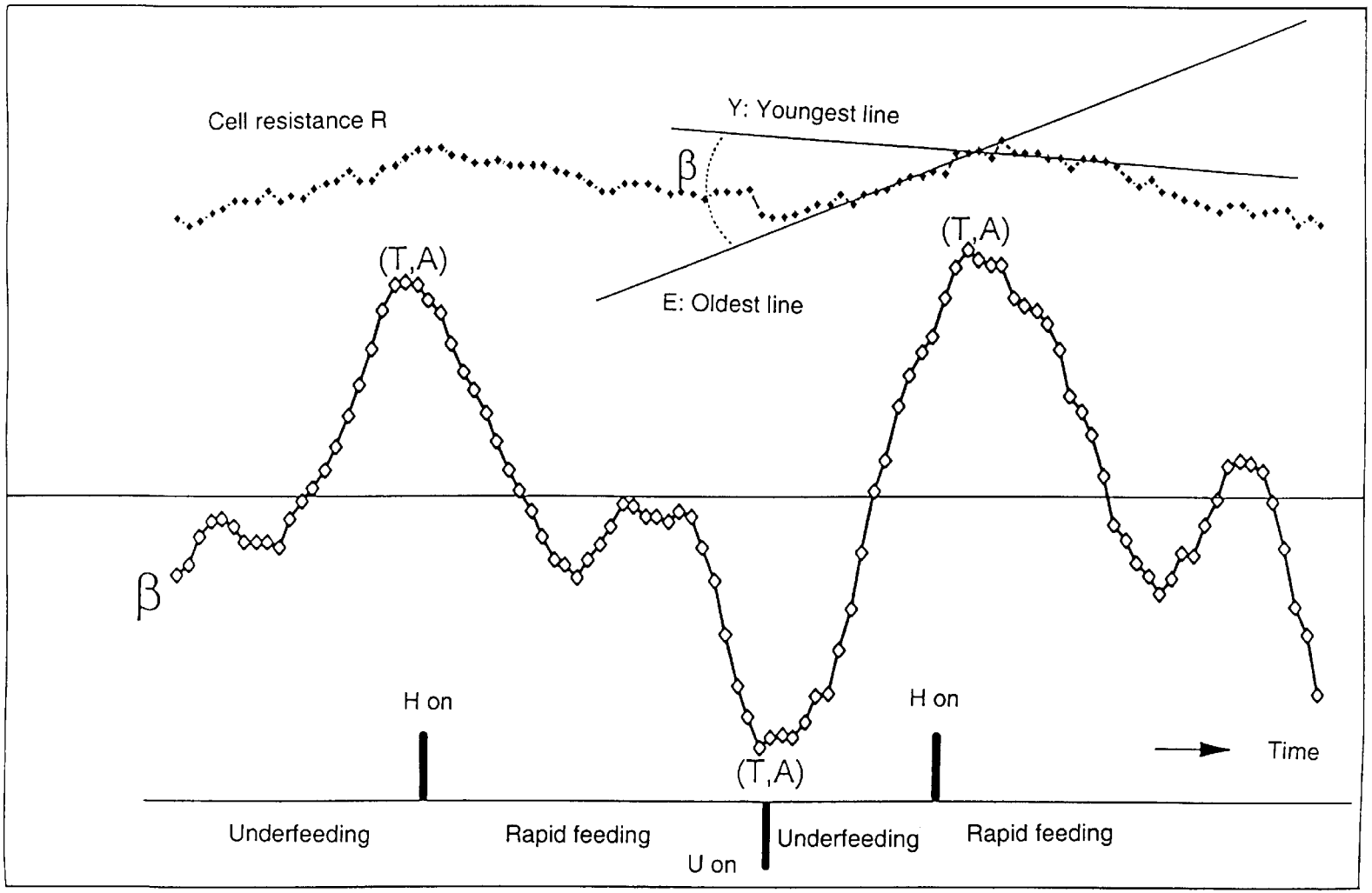

In FIG. 2, T shows the times of the maximum and minimum values on the β curve. A is the amplitude of β at the times T. After a certain delay after the times T, some values are registered which are related to the point (T, A). The delay is necessary for the mathematical calculations. The following 4 values are registered:

The angle coefficients to the lines E and Y at the point (T, A).

A (the value of β at the point (T, A) is calculated on the basis of the lines E and Y).

The time difference between the associated change in feed rate and T.

Immediately after the values are registered, the cell's state is evaluated with regard to the oxide concentration in the bath. The evaluation can be based on several sets of the registered values backwards in time, for example 3 sets.

The procedure for controlling the oxide supply comprises measurement of the electrical resistance between the electrodes of the electrolysis cell. The value of the resistance is registered at fixed intervals of time when the oxide is supplied to the electrolysis cell in periods of rapid feeding (H) and underfeeding (U). At a given time (T), a first line (E) is calculated on the basis of a number of resistance values registered immediately before the time (T). A second line (Y) is calculated on the basis of a number of resistance values registered immediately after the time (T), after which an angle (β) between the first line (E) and the second line (Y) is determined so that, for several times (T), amplitude values (A) are registered for β and angle coefficients are registered for the lines (E) and (Y). On the basis of several calculated values of β and possibly the angle coefficient for Y for a number of times equal to the measuring times for the resistance, one or more curves are produced and the registered values and curves are compared with the times for rapid feeding (H on) and underfeeding (U on) in order to estimate the oxide concentration of the electrolysis bath.

The control is used to avoid oxide concentrations which are lower than a predetermined value so that the undesired anode effect does not occur or to detect oxide concentrations which are higher than a predetermined value so that an undesired high oxide concentration can be avoided.

The control can be used to reduce the oxide sludge in an electrolysis cell with too much sludge or used to detect an imbalance between energy supply and decomposition of oxide supplied to the bath from the outside.

The values registered in connection with the control can be used to monitor the cell state. Moreover, the control can constitute an integral part of a known control for an electrolysis cell which is based on measurement of electrical resistance. On the basis of the above, some variables have now been produced which can be used to describe the oxide concentration in the bath. These can be implemented in relation to conventional control strategy in such a way that when angle detection shows a high concentration, "rhythm feeding" can be used until the concentration is low. Rhythm feeding is set here so that the oxide quantity via the feeders is below theoretical consumption. At a low concentration, the standard prediction mechanism is used to control the feeding. At an extremely low concentration, energy pulses and a high feed rate can be used to avoid the anode effect. The resistance curve is monitored continuously and in parallel using angle detection. The mechanism will result in a systematic consume of sludge and, in the long term, produce a lower degree of auto-feeding. Good prediction signals require a low degree of auto-feeding.

At a high oxide concentration, the cell is controlled using rhythm feeding until the concentration is again estimated to be low or close to the anode effect. Feeding continues with a mixture of long underfeeding periods and rapid changes between rapid feeding and underfeeding to produce R signals. The feed sequence has an average feed rate which will lead to a reduction of the quantity of sludge in the cell. This does not apply to cells which have an extremely low current efficiency.

The above control can be implemented in a known control by performing continuous monitoring of the cell's assumed oxide concentration. If the cell is close to the anode effect, the automatic system will attempt to prevent the anode effect using an increased feed rate and power pulse. At a low oxide concentration, the cell is controlled as usual using predictions.

Anode adjustment is normally performed at the end of the rapid feeding period in order to produce minimal disturbance of the resistance signals used for the control. If the resistance is far outside the deadband, however, the anode is adjusted inside the deadband using different rules.

Even though the mechanism described is intended in particular for use in connection with Søderberg cells, it should be understood that the mechanism can also be used in connection with cells which have prebake anodes.

Figure 4:
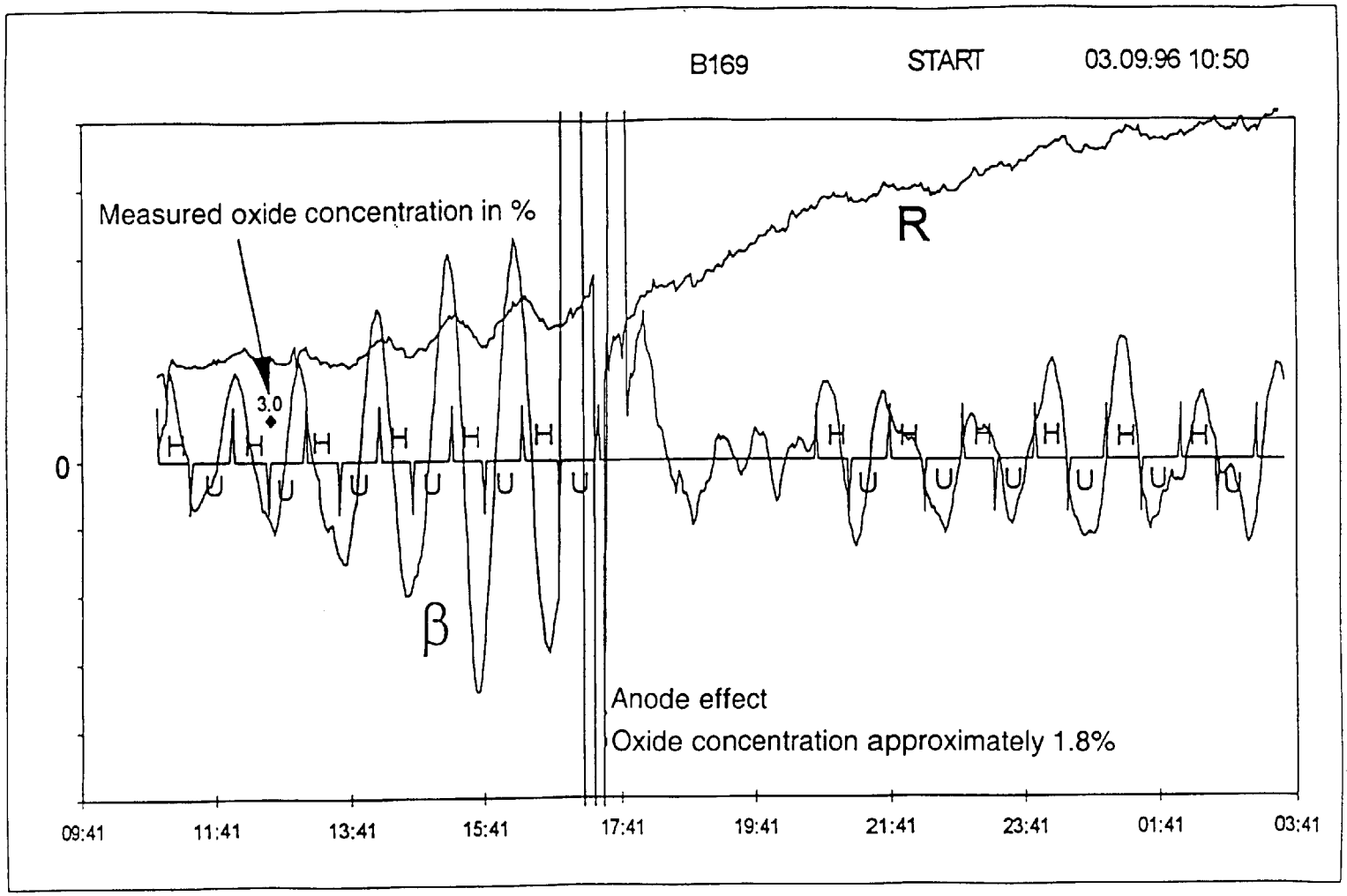

FIG. 4 shows a typical β curve before and after the anode effect in cell B169, which is a 130 kAmp Søderberg cell with 4 point feeders. The setpoint for the surplus aluminium fluoride in the bath is 11% in percentage weight.

The oxide concentration in the bath was measured approximately 4 hours before the anode effect and had a value of 3% at that time. The concentration decreases with time until the anode effect takes place at approximately 17.20. Just before 17.20, the oxide concentration is approximately 1.8%. During the anode effect, operations are performed on the cell to bring the concentration up to approximately 5%. Normally, the concentration will remain high for many hours after the anode effect on account of auto-feeding.

The co-ordinate-transformed cell resistance R, bars for change in feed rate and β are shown in the same diagram. Periods with rapid feeding are marked with H and periods with underfeeding with U. The influence of the anode adjustments on R is eliminated. The zero line for β is shown. The amplitude of β increases as the concentration decreases before the anode effect. The times of the bars and the external points in β coincide in the period with low oxide concentration. The angle coefficient for R in H periods increases as the concentration decreases.

In the period with a high oxide concentration after the anode effect, the amplitude of β is relatively small. The times of the bars and the associated times of the external points in β do not coincide.

Figure 5:
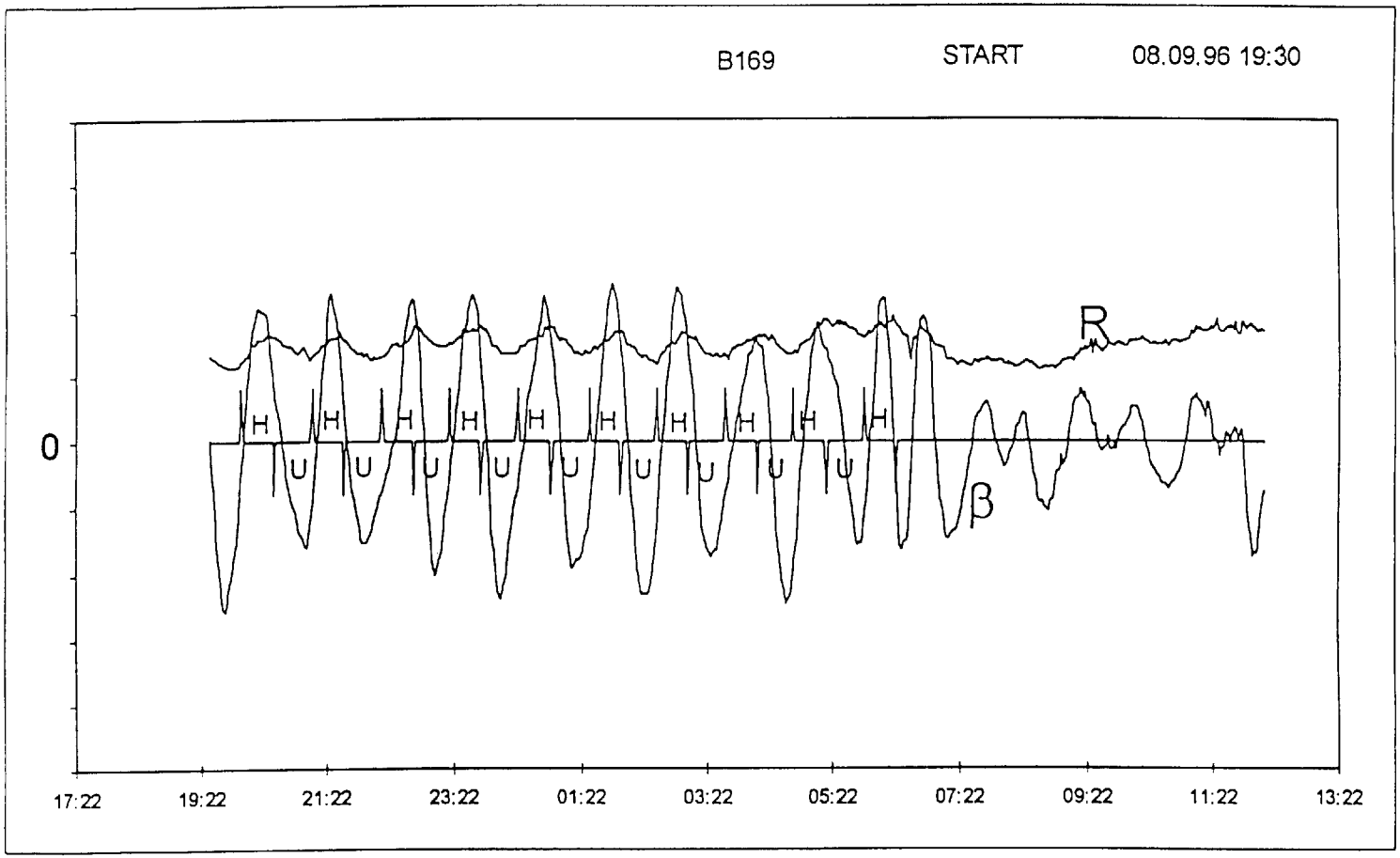

FIG. 5 shows registration of the hysteresis effect. The curves and symbols of the figure follow the description of FIG. 4 above.

In the period before 06.30, the cell had rhythm feeding for a long period of time. The hysteresis effect is, as stated earlier, characterized in that the cell resistance decreases with underfeeding and increases with overfeeding. Known controls are based on the opposite occurring, i.e. increasing R with underfeeding and decreasing R with rapid feeding.

What is claimed is:

1. A method for controlling the supply of aluminium oxide to electrolysis cells for the production of aluminium in which the control comprises measurement of the electrical resistance between the electrodes of the electrolysis cell and in which the value of the resistance is registered at fixed intervals of time and the oxide is supplied to the electrolysis cell in periods of rapid feeding (H) and underfeeding (U), characterized in that at a given time (T) a first line (E) is calculated on the basis of a number of resistance values registered immediately before the time (T) and a second line (Y) is calculated on the basis of a number of resistance values registered immediately after the time (T), after which an angle (β) is determined between the first line (E) and the second line (Y) so that, for several times (T), amplitude values (A) are registered for β and angle coefficients are registered for the lines (E) and (Y) and one or more curves are produced on the basis of several calculated values of β and possibly the angle coefficient for Y for a number of times equal to the measuring times for the resistance and that the registered values and curves are compared with the times for rapid feeding (H on) and underfeeding (U on) in order to estimate the oxide concentration of the electrolysis bath.

2. A method in accordance with claim 1, characterized in that the control is used to avoid oxide concentrations which are lower than a predetermined value so that the undesired anode effect does not occur.

3. A method in accordance with claim 1, characterized in that the control is used to detect oxide concentrations which are higher than a predetermined value so that an undesired high oxide concentration can be avoided.

4. A method in accordance with claim 1, characterized in that the control leads to a reduction in oxide sludge in an electrolysis cell with too much sludge.

5. A method in accordance with claim 1, characterized in that the control is used to detect an imbalance between the energy supply and the decomposition of the oxide supplied to the bath from the outside.

6. A method in accordance with claim 1, characterized in that the values registered in connection with the control are used to monitor the cell state.

7. A method in accordance with claim 1, characterized in that the control constitutes an integral part of a known control for an electrolysis cell which is based on the measurement of electrical resistance.

* * * * *